US005812911A

United States Patent [19]

Asanae

[11] Patent Number: 5,812,911

[45] Date of Patent: Sep. 22, 1998

[54] METHOD OF ELECTROSTATICALLY FORMING VISUAL IMAGE

[75] Inventor: Masumi Asanae, Kumagaya, Japan

[73] Assignee: Hitachi Metals, Ltd., Tokyo, Japan

[21] Appl. No.: 888,163

[22] Filed: Jul. 3, 1997

Related U.S. Application Data

[63] Continuation of Ser. No. 499,905, Jul. 11, 1995, abandoned.

[30] Foreign Application Priority Data

Jul. 13, 1994 [JP] Japan ..... 6-160881

[51] Int. Cl.[6] ..... G03G 15/22

[52] U.S. Cl. ..... 399/130; 399/159; 399/274

[58] Field of Search ..... 399/130, 131, 399/159, 222, 265, 267, 274, 279, 284

[56] References Cited

U.S. PATENT DOCUMENTS

| | | | |
|---|---|---|---|
| 3,816,840 | 6/1974 | Kotz . | |
| 3,924,945 | 12/1975 | Weigl | 399/131 |
| 4,760,422 | 7/1988 | Seimiya et al. . | |
| 4,804,994 | 2/1989 | Sasaki et al. . | |
| 5,138,387 | 8/1992 | Sato et al. . | |
| 5,157,442 | 10/1992 | Tanigawa et al. . | |
| 5,172,163 | 12/1992 | Yamaoki et al. . | |
| 5,177,537 | 1/1993 | Okano et al. . | |
| 5,256,513 | 10/1993 | Kawamura et al. | 430/106.6 |
| 5,289,237 | 2/1994 | Hashizume et al. . | |
| 5,319,337 | 6/1994 | Matsunari et al. . | |
| 5,333,041 | 7/1994 | Ito et al. | 399/149 |
| 5,381,215 | 1/1995 | Haneda et al. . | |
| 5,432,033 | 7/1995 | Asanae et al. | 430/35 |
| 5,467,175 | 11/1995 | Takagaki et al. . | |
| 5,519,472 | 5/1996 | Ojima et al. . | |
| 5,539,368 | 7/1996 | Yamashita . | |
| 5,585,901 | 12/1996 | Watanabe et al. | 399/267 |

FOREIGN PATENT DOCUMENTS 6-180533 6/1994 Japan .

OTHER PUBLICATIONS

Schaffert, R.M., M.A., Ph.D., Electrophotography, 1975, p. 38.

*Primary Examiner*—Sandra L. Brase
*Attorney, Agent, or Firm*—Morgan, Lewis & Bockius LLP

[57] ABSTRACT

An electrophotographic image-forming method in which a thin layer of a developer is formed on a developing roll by an elastic doctor blade tangentially contacting with the surface of the developing roll, and an image-bearing member and the developing roll are brought into contact with each other in a developing zone because either of which is made flexible. In the method of the present invention, the toner remaining on the surface of the image-bearing member is effectively removed and recovered in the developing zone. This prevents the background fogging. The flexible structure of either of the image-bearing member and the developing roll prevents the surface of the image-bearing member from being damaged to ensure a printed image of high quality.

12 Claims, 1 Drawing Sheet

METHOD OF ELECTROSTATICALLY FORMING VISUAL IMAGE

This application is a continuation of application Ser. No. 08/499,905, filed Jul. 11, 1995, now abandoned.

BACKGROUND OF THE INVENTION

The present invention relates to a method of electrophotographically producing a visual toner image on a recording sheet, and more particularly to an electrophotographic image-forming method which allows easy recovery of toners remaining on the surface of an image-bearing member and minimally distorts printed image.

It is known that electrophotographic processes and electrostatic recording or printing methods are generally used to duplicate or reproduce an analog or digital data such as characters, graphics, etc. For instance, in an electrophotographic copying machine or facsimile, a photosensitive layer or dielectric layer is charged to a uniform potential and the charged portion is exposed to light image of original data to form a electrostatic latent image. The latent image is developed by bringing a magnetic brush into contact with the latent image, thereby adhering a toner to the latent image to form a visual toner image. Generally, the toners used there are those which are electrostatically chargeable to a polarity by a frictional contact with carrier particles, or magnetic toners which are composed primarily of a magnetic powder and a resin binder. However, such an electrophotographic image-forming method requires the electrophotographic copying apparatus to have an electrostatic latent image-forming means including charging unit, in addition to a developing means, to uniformly charge a surface of an image-bearing member, resulting in complicated structure, large-scale equipment, etc.

U.S. Pat. No. 3,816,840 discloses a method in which a magnetic conductive toner is magnetically attracted to and retained on a sleeve made of a non-magnetic conductive material and a recording sheet is transported between the sleeve and a recording electrode disposed opposite to the sleeve. When electric data signals are applied to the electrode, a latent image is formed on the recording sheet and simultaneously the magnetic toner electrostatically charged is adhered to the recording sheet.

Regarding such direct recording methods, there has been many other proposals, all of which, however, are concerned with electrically recording methods using a recording electrode and a counter electrode opposed thereto. To obtain better printed images, these methods must be carried out under strictly controlled conditions including a gap between both electrodes, an amount of toner supplied to the recording sheet, etc. When an ordinary paper is used as the recording sheet, a surface potential of the paper is considerably affected by environmental conditions such as a moisture, a temperature and the like. Therefore, developing conditions must be adjusted depending on the environmental conditions. In addition, a high-speed recording by this recording method is quite difficult. For these reasons, the direct recording methods using ordinary papers as the recording sheet has not yet been reduced into practice.

Further, there has been proposed a method in which a light-transmitting image-bearing member is exposed to a light image corresponding to an original image from a back side to form an electrostatic latent image on a surface of the image-bearing member, and the latent image is developed simultaneously by selectively attracting thereon a toner in a developer (one-component developer consisting of a magnetic conductive toner, two-component developer consisting of a magnetic conductive carrier and a insulating toner, etc.) which is supplied by a developing roll composed of a permanent magnet and a sleeve. The developed image is then transferred and fixed onto a recording sheet.

However, in such recording method employing a rear side exposure, an image-bearing member and a developing roll both having a rigid surface are used and the thickness of magnetic brush layer formed on the surface of a developing roll is regulated to about 0.5 mm. Therefore, the toner remaining on the image-bearing member after transfer of the toner images onto a recording sheet is likely to remain without being recovered in a developing region defined by the gap between the image-bearing member and the developing roll. The toner not recovered is re-transferred onto a recording sheet in the next development operation to undesirably bring about a so-called memory effect. Such a recording method further involves a problem of scattering of the magnetic developer. Thus, the above problems cause deterioration in image resolution and developability.

It has been further proposed to reduce the gap between the image-bearing member and the developing roll in the developing region. However, too small of a gap causes damage to the surface of the image-bearing member and a short lifetime of the magnetic developer.

OBJECT AND SUMMARY OF THE INVENTION

Accordingly, an object of the present invention is to provide an improved method of electrophotographically producing a visual toner image on a recording sheet, which can effectively recover toners remaining on the surface of the image-bearing member, is free from scattering of the developer and damage of the the of image-bearing member, and can form high quality images on a recording paper.

As a result of intense investigations by the inventors, it has been found that the above object can be attained by forming on the surface of developing roll a thin layer of the developer by a doctor blade made of an elastic material and disposed so as to tangentially contact with the surface of developing roll, and by bringing the image-bearing member and the developing roll, either of which is made flexible, into contact with each other in the developing zone. The present invention has been accomplished based on the findings.

Thus, in an aspect of the present invention, there is provided a method of electrophotographically producing a visual image, comprising (1) electrostatically charging a surface of a rotating hollow cylindrical image-bearing member made of a light-transmitting material to a uniform potential; (2) exposing the electrostatically charged portion of said image-bearing member to a light image of original informational data being reproduced from a rear side to form an electrostatic latent image corresponding to said original informational data; (3) developing said latent image by bringing a developer containing an electrically insulating and triboelectrically chargeable toner into contact therewith in a developing zone to form a toner image on said image-bearing member, said developer being attracted on the surface of a rotating developing roll, being formed into a thin layer by a doctor blade tangentially disposed in pressure-contact with the surface of said developing roll, and being transported to said developing zone by the rotation of said developing roll; (4) transferring said developed toner image onto a recording sheet; and (5) fixing said transferred toner image to said recording sheet, either of said image-bearing member and said developing roll being made into flexible to being brought into close contact with each other via said thin layer of said developer in said developing zone.

DETAILED DESCRIPTION OF THE INVENTION

Figure 1:
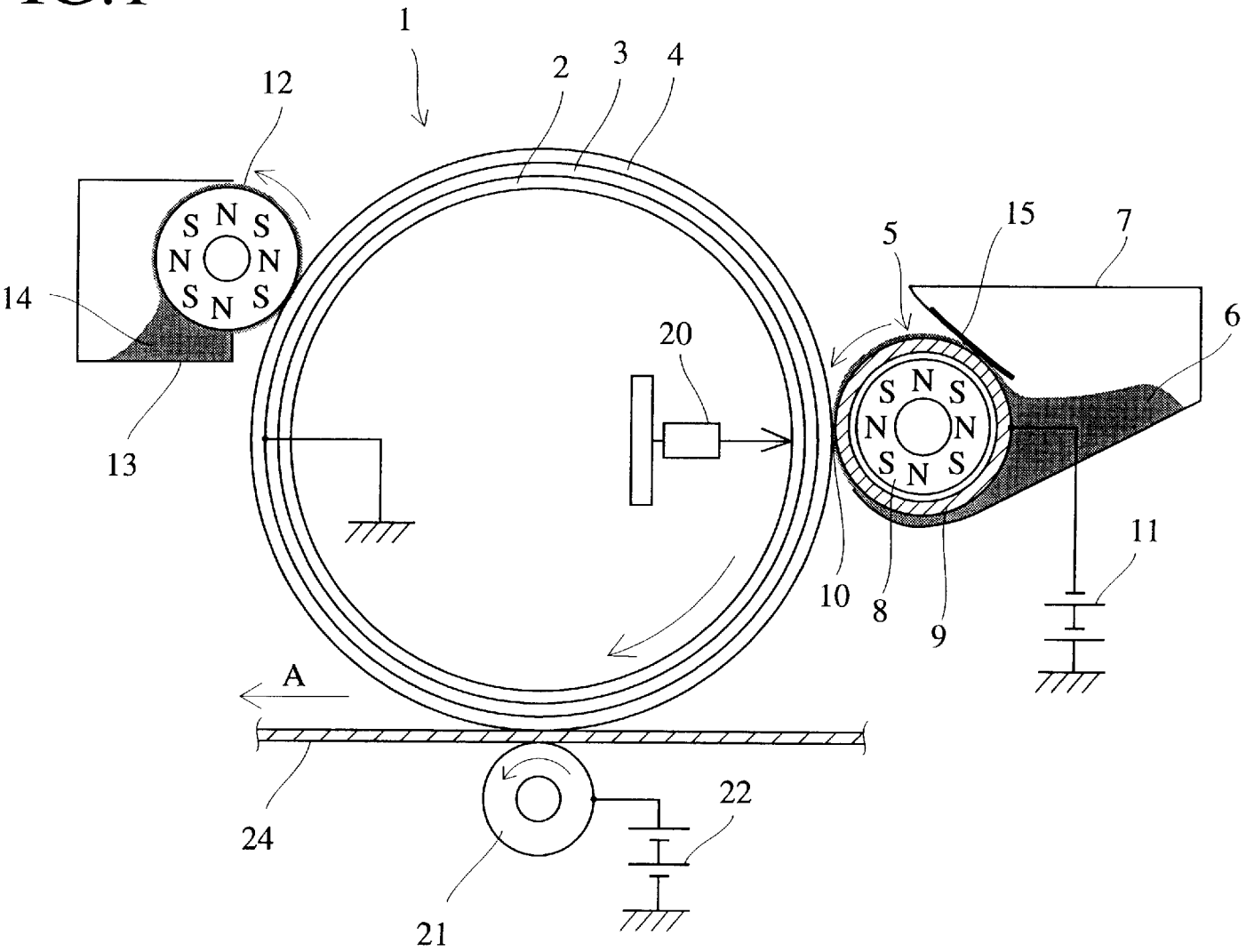
FIG. 1 is a schematic side view showing one example of an electrophotographic recording apparatus accomplishing a method according to the present invention.

The present invention will be described in detail below.

One of the characteristic features of the present invention resides in bringing the image-bearing member and the developing roll into contact with each other in the developing zone through the thin layer of the developer. In order to achieve this construction, either of the image-bearing member and the developing roll is made into flexible.

A flexible image-bearing member may have a laminated construction comprising a flexible support layer made of a transparent resin material such as polyesters, polycarbonates, polyethylene terephthalate, etc., a light-transmitting electroconductive layer made of ITO (indium•tin•oxide), lead oxide, indium oxide, copper iodide, etc. on the support layer, and a photoconductive layer made of OPC (organic photoconductive) material on the light-transmitting electroconductive layer. The flexible support is formed into hollow cylindrical form having support rings made of metallic material such as aluminum alloy, etc. at the both opposite ends for maintaining the hollow cylindrical form. The flexible support layer may be also formed into an endless belt.

The thickness of the light-transmitting electroconductive layer is preferably 10 Å to 20 $\mu$m for and the thickness of the photoconductive layer is preferably 5–30 $\mu$m The production method of such laminated structure is not strictly restricted, and may be produced according to the techniques per se known in the art.

The developing roll which is disposed opposite the above flexible image-bearing member is composed of a hollow cylindrical sleeve and a cylindrical permanent magnet member having a plurality of magnetic poles and mounted in the sleeve when a magnetic developer (one-component developer containing a magnetic toner, and two-component developer containing a magnetic or non-magnetic toner and a magnetic carrier) is used. The sleeve may be made of a non-magnetic, and preferably electroconductive material such as austenitic stainless steel, aluminum alloy etc. The whole body of the permanent magnet member may be made of a permanent magnet, or the permanent magnet member may comprises a shaft and a permanent magnet disposed around the shaft. The sleeve and the permanent magnet member are disposed so as to rotate relative to each other. The developing roll may be also composed of only a rotatable magnetic member of solid or hollow cylinder without using a sleeve. As the permanent magnet member, a sintered ferrite magnet, a resin magnet using a thermoplastic resin such as polyamide, ethylene-vinyl acetate copolymer, etc. may be used. When a non-magnetic developer (one-component developer containing a non-magnetic toner) is used, the developing roll composed of the sleeve alone may be employed.

A flexible developing roll used with the magnetic developer may be composed of a flexible permanent magnet member of solid or hollow cylinder alone. Such a flexible permanent magnet member may be made, for example, of a mixture comprising 100 weight parts of a rubber material such as urethane rubbers, silicone rubbers, butyl rubbers, etc., 100–500 weight parts of ferromagnetic powder such as ferrite powder, rare earth magnet powder, etc., 10–120 weight parts of an electroconductive material such as carbon black (powder or fiber) and metal powder, and a vulcanization accelerator, by sequential steps of kneading, casting at ordinary temperature and pressure, vulcanization, ground finish and magnetization.

The flexible permanent magnet member is preferred to have 12 or more of magnetic poles to prevent uneven development, a surface magnetic flux density of 100 G or more, preferably 150 G or more to eliminate toner scattering, and a specific volume resistance of $10^9$ Ω·cm or less, preferably $10^5$ Ω·cm or less (measured by Wheatstone bridge method) to ensure the application of bias voltage. Since an excess amount of the ferromagnetic power and/or the electroconductive material results in increased surface hardness, the amount of these components should be selected to make the surface hardness (Hs) is 60° or less, preferably 45° or less (JIS A). For example, a flexible developing roll composed of a shaft (6 mm diameter and 280 mm length) made of mild steel and a rubber magnet layer (7 mm thickness and 227 mm length) around the shaft shows a specific volume resistance of $1\times10^3$ Ω·cm, a surface hardness (Hs) of 40° and a surface magnetic flux density of 150 G when the rubber magnet is made of 100 weight parts of urethane rubber, 200 weight parts of Sr-ferrite and 60 weight parts of carbon black. A similar flexible developing roll made of 100 weight parts of urethane rubber, 400 weight parts of Sr-ferrite and 100 weight parts of carbon black shows a specific volume resistance of $5\times10^3$ Ω·cm, a surface hardness (Hs) of 42° and a surface magnetic flux density of 250 G.

When the non-magnetic developer is used, the flexible developing roll may be composed of an elastic roll comprising a shaft made of an electroconductive material and an electroconductive rubber layer around the shaft. The rubber layer is preferred to have a specific volume resistance of $10^6$ Ω·cm or less, and is produced from a mixture, for example, comprising 100 weight parts of a rubber material, 10–120 weight parts of an electroconductive material, and a vulcanizingly effective amount of a vulcanization accelerator. The rubber material and the electroconductive material may include the same materials as for the flexible permanent magnet member used with the magnetic developer.

When the flexible developing roll as described above is used, a light-transmitting image-bearing member used in known electrophotographic recording machines employing the rear side exposure may be used. For example, such a light-transmitting image-bearing member comprises a transmitting support layer made of resin, glass such as soda glass, pyrex, etc., a light-transmitting electroconductive layer, and a photoconductive layer made of OPC, amorphous silicon, etc.

Another characteristic feature of the present invention is in an elastic doctor blade disposed so as to tangentially contact with the surface of the developing roll. When a developer magnetically or electrostatically attracted on the surface of the developing roll passes through between the doctor blade, the developer is made into a thin layer of 10–100 $\mu$m thick by the elastic recovering force of the doctor blade. The elastic material for the doctor blade may be include phosphor bronze, austenitic stainless steel, etc. The thickness of the doctor blade is not specifically restricted as far as the doctor blade has an elasticity sufficient for forming the thin layer of the developer having a thickness of the above range.

In the present invention, any of (A) one-component developer containing a magnetic toner, (B) two-component developer containing a magnetic toner and a magnetic carrier, (C) one-component developer containing a non-magnetic toner, and (D) two-component developer containing a non-magnetic toner and a magnetic carrier can be used. Each of the developers (A), (B) and (D) is referred to as a magnetic developer, and the developer (C) as a non-magnetic developer.

The magnetic developer (A) may be attracted and retained magnetically on the surface of developing roll in which a permanent magnet having a plurality of magnetic poles is mounted.

The magnetic developer (B) may be attracted and retained magnetically on the surface of the developing roll, and can charge the surface of the image-bearing member uniformly in the upstream of the developing zone. The toner concentration is preferably 5–90 weight %, and more preferably 10–50 weight %.

The developer (C) may be attracted and retained electrostatically on the electroconductive surface of the developing roll.

The magnetic developer (D) may be attracted and retained magnetically on the surface of the developing roll, and can charge the surface of the image-bearing member uniformly in the upstream of the developing zone. The toner concentration is preferably 2–10 weight %, and more preferably 3–6 weight %.

The triboelectrically chargeable toner used in the developer has preferably a volume-average particle size of 3–20 $\mu$m, more preferably 5–13 $\mu$m. When a particle size of the toner is too small, background fogging and toner scattering may occur. On the other hand, when the particle size is too large, resolution and developability of the toner image are undesirably lowered. A magnetic toner may contain a magnetic powder of compounds or alloys (ferrites, magnetites, etc.) containing ferromagnetic element such as iron, cobalt, nickel, etc. To uniformly disperse the magnetic powder in the magnetic toner, the magnetic powder has preferably an average particle size of 0.01–3 $\mu$m and a content of 10–75 weight %.

The volume specific resistance of the toner is preferably $10^{12}$ Ω·cm or greater. If the volume specific resistance is less than $10^{12}$ Ω·cm, charging and transferring processes can not be satisfactorily conducted due to its low chargeability.

The binder resin for the toner may include those mentioned below.

When a heat-fixing system using an oven or heat roll is employed, suitable examples of the binder resin are, for instance, thermoplastic vinyl resins including homopolymers and copolymers of styrene compounds, vinyl esters, esters of α-methylene-aliphatic monocarboxylic acids, acrylonitrile, methacrylonitrile, acrylamides, vinyl ethers, vinyl ketones, N-vinyl compounds, etc. The above homopolymers and copolymers may be used alone or in combination. Further, non-vinyl thermoplastic resins such as bisphenol-type epoxy resins, oil-modified epoxy resins, polyurethane resins, cellulose resins, polyether resins, polyester resins, etc. may be used alone or in combination with the above thermoplastic vinyl resins.

When the pressure-fixing system is employed, examples of the binder resin for the toner may include pressure-sensitive resins such as higher aliphatic acid, higher aliphatic acid derivatives, higher aliphatic acid amides, waxes, rosin derivatives, alkyd resins, epoxy-modified phenol resins, natural resin-modified phenol resins, amino resins, silicone resins, urea resins, oligomers of (meth)acrylic acid and long-chain alkyl (meth)acrylate, polyolefins, ethylene/vinyl acetate copolymers, ethylene/vinyl alkyl ether copolymers, maleic acid anhydride-type copolymers, etc.

Any of the above resins may be used alone or in combination. However, in view of flowability of the toner, it is preferred that the resins or resin mixtures have a glass-transition temperature of greater than 40° C. An additive such as pigments, dyes, etc. used in dry developers may be contained in the toner. The content of the additive is preferably 10 weight % or less in view of fixing ability.

The toner can be prepared by kneading the raw materials under heating, cooling and hardening, then pulverizing and classifying to obtain toner particles having a predetermined particle size.

The magnetic carrier used in the magnetic developer has preferably an average particle size of 3–50 $\mu$m and a volume specific resistance of $10^3$–$10^{14}$ Ω·cm, more preferably $10^5$–$10^9$ Ω·cm. Suitable examples of such a magnetic carrier may include ferromagnetic particles having the above characteristics. The ferromagnetic particles may be dispersed in a resin binder. Among them, particles of magnetite and ferrite are preferable. The magnetic carrier may be used with or without a resin coat layer. An electroconductive particle such as carbon black may be coated on the magnetic carrier particle to make the carrier electroconductive.

Material for the resin coat layer may include silicone resins, styrene-acrylic acid resins, polyester resins, maleic acid resins, acrylic acid resins, modified products of these resins, etc. To strongly bind the resin coat layer onto the magnetic carrier, a hardening agent may be added to the resins. Suitable hardening agents include thermosetting compounds such as melamine and amine salts. Further, to improve a bindability to magnetic carrier particles, wear-resistance and flowability of the developer, to prevent the toner from welding to the magnetic carrier, and to regulate the chargeability of the toner, the resin coat layer may be further added with a small amount of phenol resins, urea resins, alkyd resins and other additives such as fillers, diluents, plasticizers, etc.

When a developer having a high specific volume resistance (one-component developer containing a magnetic or a non-magnetic toner) is used, a charging unit is preferred to be provided because it is difficult to charge the image-bearing member to a desired potential (several hundreds volt) by injecting charges, utilizing the developing bias applied to the developing roll (sleeve) into the photoconductive layer of the image-bearing member through the developer (toner) present in the developing zone.

On the other hand, when a developer having a low specific volume resistance (two-component developer containing a magnetic carrier having a specific volume resistance of $10^5$Ω·cm or less) is used, a charging unit is not necessarily required because the image-bearing member can be easily charged to a desired potential by injecting charges into the photoconductive layer of the image-bearing member through the magnetic carrier present in the developing zone.

In the known electrostatic printing methods, a charging means and a transferring means both utilizing corona discharging are employed. However, undesired by-products such as ozone, nitrogen oxides (NOx), etc. are formed upon corona discharging and the surface of image-bearing member is deteriorated by such products. Therefore, it is preferable to employ the following charging means and transfer means to avoid the formation of undesired products.

The charging means, disposed on the upstream side of the developing zone with respect to the rotation direction of the image-bearing member, includes a rotatable charging roll made of a permanent magnet having a plurality of magnetic poles on the surface thereof and positioned opposite to the image-bearing member with a gap. The plurality of magnetic poles are arranged at equal spaces along the outer circumferential surface of the roll and extend in the axial direction of the roll. Alternatively, the charging roll may be constructed by disposing a plurality of rectangular permanent-magnet blocks along the circumferential surface of a cylindrical body. The charging roll attracts on its surface a charging material comprising a magnetic toner and a magnetic carrier to form magnetic brush. The magnetic brush is brought into slide contact with the surface of the image-bearing member upon the rotation of the charging roll to charge the surface of the image-bearing member to uniform potential.

The magnetic carrier used in the charging material has a volume specific resistance of less than $10^7$ Ω·cm. When the volume specific resistance of the magnetic carrier is $10^7$ Ω·cm or greater, a sufficient potential is not attained on the surface of the image-bearing member.

Suitable examples of such a magnetic carrier include those used as a carrier for usual two-component developer. For instance, an iron powder, ferrite powder such as Ni—Zn ferrites, Mn—Zn ferrites and Cu—Zn ferrites, magnetite particles, etc. may be exemplified. The magnetic carrier preferably has an average particle size of 10–200 μm. A granulated magnetic carrier prepared from fine particles of 5 μm or less in size and having an average particle size of 10–200 μm may be also usable. Although such particles are usable without any treatment, the magnetic carrier is preferably coated with a resin layer such as fluorocarbon resins, styrene resins, polyester resins, epoxy resins or the mixture of these resins. Alternatively, the magnetic carrier and the resin binder may be mixed together and formed into composite particles. Further, conductive particles such as carbon black may be added and adhered to the surface of the resin-coated carrier or the core particle.

As the toner for the charging material, those for the developer described above may be used.

For a general understanding of the features of the present invention, reference is made to FIG. 1 which schematically shows an electrophotographic recording apparatus for practicing the method of the present invention, in which the image-bearing member is made into flexible.

The hollow cylindrical flexible image-bearing member 1 comprises a flexible support layer 2 made of a transparent material such as polyester resin, a light-transmitting electroconductive layer 3 formed on the support layer 2, and a photoconductive layer 4 made of a light-transmitting photoconductive material and formed on the electroconductive layer 3. The image-bearing member 1 is rotatable by a driving means (not shown) in the direction indicated by the arrow. A protective layer made of a wear-resistant material may be formed on the photoconductive layer 4, if desired. For example, the electroconductive layer 3 having a thickness of about 1000 Å is formed on the support layer 2 having a thickness of 0.5–1 mm by depositing ITO (indium•tin•oxide) by an activated reaction depositing method. The image-bearing member 1 has the support rings (not shown) made of a rigid material at both the ends to maintain the cylindrical shape. With the above structure, the surface of the image-bearing member 1 has flexibility.

A developing means is disposed opposite to the image-bearing member 1. The developing means comprises a hopper 7 storing a magnetic developer 6 and a developing roll 5 partially received in the hopper 7. The developing roll 5 contacts with the surface of the image-bearing member 1 through the thin layer of the developer 6. The image-bearing member 1 and the developing roll 5 cooperate to define a developing zone 10 where a latent image on the image-bearing member 1 is developed by a magnetic developer 6 to form a visual toner image. The developing roll 5 comprises an inner permanent magnet member 8 provided with a plurality of magnetic poles on the surface, and an outer hollow cylindrical sleeve 9 made of a non-magnetic material such as aluminum alloy, austenitic stainless steel, etc. The sleeve 9 is disposed coaxially with the permanent magnet member 8. The developer 6 is transported from the hopper 7 to the developing zone 10 by a relative rotation of the permanent magnet member 8 and the sleeve 9. In addition, the sleeve 9 is electrically connected with a bias voltage source 11 so that a bias voltage is applied to the sleeve 9. The reference numeral 15 is a doctor blade made of an elastic material such as phosphor bronze and austenitic stainless steel, and disposed in the hopper 7 to tangentially pressure-contact with the surface of the developing roll 5 by means of elastic recovering force. The developer 6 is made into a thin layer when passing through the doctor blade 15 and transported to the developing zone 10.

A charging means is disposed in the vicinity of the image-bearing member 1. The charging means comprises a hopper 13 storing a charging material 14 and a charging roll 12 made of a permanent magnet having a plurality of magnetic poles on its surface. The charging roll 12 is disposed opposite to the image-bearing member 1. The charging material composed of a magnetic toner and a magnetic carrier is attracted on the surface of the rotating charging roll 12 to form magnetic brush which charges the surface of the image-bearing member 1 to uniform potential by brushing the surface.

A light image exposing means 20 (for example, LED array) is mounted inside the image-bearing member 1 in opposition to the developing zone 10 so that the outer surface of the image-bearing member 1 may be subjected to rear side exposure to a light image corresponding to an original image being reproduced.

A transfer roll 21 made of a conductive material such as copper, copper alloy, etc. is electrically connected to a grounded bias voltage source 22 and rotatably disposed in pressure-contact with the image-bearing member 1. A recording sheet 24 is supplied between the image-bearing member 1 and the transfer roll 21 in a direction indicated by the arrow A and then delivered to a fixing means (not shown). A slip-transfer method may be employed by using a transfer roll composed of a rigid metal core and an outer layer made of an elastic material such as rubber. In this method, a slight slip between the image-bearing member 1 and the recording sheet 24 is caused to transfer a developed toner image onto the recording sheet 24. Further, a pressure-transfer method may be employed by using a transfer roll 21 composed of a metal core and a hard outer layer or only metal core so as to make the nip between the image-bearing member 1 and the recording sheet 24 small. Additionally, a electrostatic transfer method may be applied by using a transfer roll made of an electroconductive rubber.

With the electrostatically recording apparatus having the above construction, a printed image is reproduced on a recording sheet as described below.

The magnetic charging material 14 is attracted on the rotating charging roll 12 to form magnetic brush which brushes the surface of the image-bearing member 1 to electrostatically charge the surface of the image-bearing member 1 to a uniform potential. Separately, the magnetic developer 6 attracted on the rotating developing roll 5 forms a thin layer (thickness: about 0.1 mm) after passing through the doctor blade 15 and moves to the developing zone 10. In the developing zone 10, the thin layer is brought into contact with the surface of the image-bearing member 1 with a certain width in the rotation direction, thereby providing the surface of the image-bearing member 1 with a triboelectric charge or potential.

The image-bearing member 1 is exposed from the rear side to the light image corresponding to the original image from the light image exposing means (LED array) 20. Exposure of the charged surface of the image-bearing member 1 selectively dissipates the charge thereon in the irradiated areas, while the charge in the non-irradiated areas remaining unchanged to record an electrostatic latent image on the image-bearing member 1 corresponding to the original information being reproduced. The non-irradiated areas and the developing roll 5 has the same potential, whereas a potential difference occurs between the irradiated areas and the developing roll 5. This forms a toner image on the image-bearing member 1 by attracting the toner in the thin layer of the developer 6 to the irradiated areas. The developed toner image moves by a further rotation of the image-bearing member 1 into a transfer zone where the toner image is transferred onto the recording sheet 24 delivered between the image-bearing member 1 and the transfer roll 21. The transferred toner image is then fixed by a fixing means (not shown) to the recording sheet 24.

The present invention will be described in more detail by way of the following examples without intention of restricting the scope of the present invention.

REFERENCE EXAMPLE (1) Preparation of Magnetic Toner

A starting mixture consisting, by weight part, of:

44 parts of styrene/n-butyl methacrylate copolymer (number-average molecular weight (Mn)=$1.6\times10^4$, weight average-molecular weight (Mw)=$21\times10^4$), 50 parts of magnetite (EPT500 manufactured by Toda kogyo K.K.), 5 parts of polypropylene (TP32 manufactured by Sanyo Chemical Industries, Ltd.), and 1 part of a negatively chargeable charge-controlling agent (Bontron E-81 manufactured by Orient Chemical Industries)

was kneaded in a kneader equipped with a heating roll for 30 minutes. After cooling and solidifying, the mixture was pulverized and classified to obtain a particle having a volume-average particle size of 10 $\mu$m. In a hot air flow of 120° C., 0.5 parts by weight of hydrophobic silica (R972 manufactured by Nippon Aerozil K.K.) was added to the particle obtained above to uniformly coat the particle with the hydrophilic silica, thereby producing a negatively chargeable magnetic toner. The magnetic toner had a volume specific resistance of $10^{14}$ Ω·cm and a triboelectric charge of −15 $\mu$C/g.

(2) Preparation of Non-Magnetic Toner

A starting mixture consisting, by weight part, of:

87 parts of polyester resin (KTR2150 manufactured by Kao Corporation), 10 parts of carbon black (#44 manufactured by Mitsubishi Chemical Corporation), 1 part of a charge-controlling agent (Kaya Charge T2N manufactured by Nippon Kayaku Co.,Ltd.), and 2 parts of polypropylene (TP32 manufactured by Sanyo Chemical Industries, Ltd.)

was subjected to the same procedure as in the preparation of the magnetic toner to obtain a non-magnetic toner having a volume-average particle size of 9 $\mu$m, a specific volume resistance of $5\times10^{14}$ Ω·cm and a triboelectric charge of −29 $\mu$C/g.

(3) Preparation of Magnetic Carrier 100 parts by weight of iron powder having an average particle size of 30 $\mu$m was mixed with 3 parts by weight of a silicone resin. The mixture was heat-treated at 170° C. for 30 minutes in a fluidized bed coating apparatus. After pulverization, the heat-treated mixture was classified to obtain a resin-coated magnetic carrier having an average particle size of 30 $\mu$m. Thereafter, 2 parts by weight of carbon black (#44 manufactured by Mitsubishi Chemical Corporation) was added to the magnetic carrier, thereby adhering the carbon black onto the resin coat. A specific volume resistance of the magnetic carrier was $5\times10^4$ Ω·cm.

The specific volume resistance was determined as follows. An appropriate amount (about 10 mg) of the toner or carrier was charged into a dial-gauge type cylinder made of Teflon (trade name) and having an inner diameter of 3.05 mm. The sample was exposed to an electric field of D.C. 100 V/cm (magnetic carrier) or D.C. 4000 V/cm (toner) under a load of 0.1 kg to measure an electric resistance using an insulation-resistance tester (4329 manufactured by Yokogawa-Hewlett-Packard, Ltd.).

The triboelectric charge of the toner was determined as follows. A developer having a toner content of 5 weight % was mixed well, and blown at a blowing pressure of 1.0 kgf/cm$^2$. The triboelectric charge of the toner thus treated was measured by using a blow-off powder electric charge measuring apparatus (TB-200 manufactured by Toshiba Chemical Co. Ltd.).

(4) Preparation of Magnetic Charging Material

The magnetic toner and magnetic carrier thus obtained were mixed together to produce a magnetic charging material having the toner content of 30 weight %.

Examples 1–4 and Comparative Example 1

Electrostatic recording was carried out under the following conditions to evaluate the developability.

In the charging means, a doctor gap between the charging roll 12 and doctor blade (not shown) was adjusted to 0.3 mm to form a layer of the charging material 14 with an adequate thickness on the charging roll 12. A charging gap between the charging roll 12 and the image-bearing member 1 was adjusted to 0.4 mm. The charging roll 12 having an outer diameter of 18 mm was made of an 8-pole permanent magnet (YBM-3 manufactured by Hitachi Metals, Ltd.). The charging roll 12 had a surface magnetic flux density of 750 G and was rotated at 1000 rpm.

The developing roll 5 was composed of a hollow cylindrical sleeve 9 made of stainless steel (SUS304) and having an outer diameter of 20 mm, and an 8-pole permanent magnet disposed within the sleeve 9. The surface magnetic flux density on the sleeve 9 was 700 G and the rotation speed of the sleeve 9 was adjusted to 150 rpm. When the one-component non-magnetic developer was used, the developing roll was composed of the sleeve 9 alone, and the rotation speed of the sleeve was adjusted to 100 rpm. The surface of the sleeve 9 was biased to −360 V.

The flexible image-bearing member 1 of 30 mm diameter was composed of the support layer 2 made of polyethylene terephthalate, the electroconductive layer 3 of 100 Å thick made of ITO, and the photoconductive layer 4 of 10 μm thick made of a negatively chargeable organic photoconductive material. The peripheral speed of the image-bearing member 1 was 50 mm/sec and the surface thereof was charged to −400 V.

The transferred toner image was fixed on the recording sheet by a heat roll at 170° C. under a line pressure of 1 kg/cm.

In Comparative Example 1, a development system by magnetic brush was employed while adjusting the developing doctor gap, which regulated the thickness of the developer layer on the developing roll 5, to 0.3 mm and the developing gap in the developing zone 10 to 0.4 mm. The other conditions were the same as described above.

The results of the evaluation are shown in Table 1.

TABLE 1

| | Toner | Carrier | Toner Content (wt. %) | Developing Doctor Gap (mm) | Developing Gap (mm) |
|---|---|---|---|---|---|
| Examples | | | | | |
| 1 | magnetic | none | 100 | 0 | 0 |
| 2 | magnetic | magnetic | 30 | 0 | 0 |
| 3 | non-magnetic | none | 100 | 0 | 0 |
| 4 | non-magnetic | magnetic | 5 | 0 | 0 |
| Comparative Example | | | | | |
| 1 | magnetic | magnetic | 30 | 0.3 | 0.4 |

| | Image Density | Fogging | Distortion of Character |
|---|---|---|---|
| Examples | | | |
| 1 | 1.37 | 1.0 | − |
| 2 | 1.35 | 0.8 | − |
| 3 | 1.32 | 0.4 | − |
| 4 | 1.43 | 0.6 | − |
| Comparative Example | | | |
| 1 | 1.43 | 5.2 | + |

Note: "−" means a little distortion was observed, and "+" means a remarkable distortion was observed.

As seen from Table 1, although Comparative Example 1 showed a slightly higher image density, a considerable fogging and distortion of character were observed because of insufficient recovery of the toner remaining on the surface of the image-bearing member 1. On the other hand, since the remaining toner was effectively recovered in the developing zone 10 in Examples 1–4, an image of high quality substantially free from fogging and distortion of character was obtained.

What is claimed is:

1. A method of electrostatically forming a visual image on a recording sheet, the method comprising the steps of:

electrostatically charging a surface of a moving flexible image-bearing endless belt or a rotating flexible hollow cylindrical image-bearing member each made of a light-transmitting material to a uniform potential, wherein said flexible image-bearing endless belt includes a flexible endless support layer made of a transparent resin material, a light-transmitting electroconductive layer of 0.1 μm to 20 μm in thickness on said flexible endless support layer and a light-transmitting photoconductive layer of 5–30 μm in thickness on said electroconductive layer, and wherein said flexible hollow cylindrical image-bearing member includes a flexible support layer made of a transparent resin material and having support rings made of metallic material at the both opposite ends thereof, a light-transmitting electroconductive layer of 0.1 μm to 20 μm in thickness on said flexible support layer, and a light-transmitting photoconductive layer of 5–30 μm in thickness on said electroconductive layer;

exposing the electrostatically charged surface of said flexible image-bearing endless belt or said flexible hollow cylindrical image-bearing member to a light image of original informational data being reproduced from a rear side to form an electrostatic latent image corresponding to said original informational data;

developing said latent image by bringing a developer containing an electrically insulating and triboelectrically chargeable toner into contact therewith in a developing zone to form a toner image on said flexible image-bearing endless belt or said flexible hollow cylindrical image-bearing member, said developer being attracted to the surface of a rotating developing roll including a hollow cylindrical sleeve and a cylindrical permanent magnet member mounted in said sleeve, being formed into a thin layer of 10–100 μm in thickness by a doctor blade tangentially disposed in pressure-contact with the surface of said developing roll, and being transported by the rotation of said developing roll to said developing zone where said developing roll is brought into close contact with said flexible image-bearing endless belt or said flexible hollow cylindrical image-bearng member through the thin layer of said developer;

transferring said toner image onto a recording sheet; and fixing said transferred toner image to said recording sheet.

2. The method according to claim 1, wherein said surface of said flexible image-bearing member is electrostatically charged by a charging means in an upstream side of said developing zone with respect to the rotation direction of said flexible image-bearing member.

3. The method according to claim 1, wherein said latent image is developed by a magnetic developer selected from the group consisting of one-component magnetic developer and two-component magnetic developer.

4. The method according to claim 1, wherein said surface of said flexible image-bearing member is electrostatically charged by a two-component developer consisting essentially of one of a magnetic and a non-magnetic toner, and of a magnetic carrier in an upstream side of said developing zone with respect to the rotation direction of said image-bearing member.

5. A method of electrostatically forming a visual image on a recording sheet, the method comprising the steps of:

electrostatically charging a surface of a moving flexible image-bearing endless belt or a rotating flexible hollow cylindrical image-bearing member each made of a light-transmitting material to a uniform potential, wherein said flexible image-bearing endless belt includes a flexible endless support layer made of a transparent resin material, a light-transmitting electroconductive layer of 0.1 μm to 20 μm in thickness on said flexible endless support layer and a light-transmitting photoconductive layer of 5–30 μm in thickness on said electroconductive layer, and said wherein flexible hollow cylindrical image-bearing member includes a flexible support layer made of a transparent resin material and having support rings made of metallic material at the both opposite ends thereof, a light-transmitting electroconductive layer of 0.1 μm to 20 μm in thickness on said flexible support layer and a light-transmitting photoconductive layer of 5–30 μm in thickness on said electroconductive layer;

exposing the electrostatically charged surface of said flexible image-bearing endless belt or said flexible hollow cylindrical image-bearing member to a light image of original informational data being reproduced from a rear side to form an electrostatic latent image corresponding to said original informational data;

developing said latent image by bringing a developer containing an electrically insulating and triboelectrically chargeable toner into contact therewith in a developing zone to form a toner image on said flexible image-bearing endless belt or said flexible hollow cylindrical image-bearing member, said developer being attracted to the surface of a rotating sleeve-less developing roll including one of a solid and a hollow cylindrical permanent magnet member, being formed into a thin layer of 10–100 $\mu$m in thickness by a doctor blade tangentially disposed in pressure-contact with the surface of said sleeve-less developing roll, and being transported by the rotation of said sleeve-less developing roll to said developing zone where said sleeve-less developing roll is brought into close contact with said flexible image-bearing endless belt or said flexible hollow cylindrical image-bearing member through the thin layer of said developer;

transferring said toner image onto a recording sheet; and fixing said transferred toner image to said recording sheet.

6. The method according to claim 5, wherein said surface of said flexible image-bearing member is electrostatically charged by a charging means in an upstream side of said developing zone with respect to the rotation direction of said flexible image-bearing member.

7. The method according to claim 5, wherein said latent image is developed by a magnetic developer selected from the group consisting of one-component magnetic developer and two-component magnetic developer.

8. The method according to claim 5, wherein said surface of said flexible image-bearing member is electrostatically charged by a two-component developer consisting essentially of a magnetic or non-magnetic toner and a magnetic carrier in an upstream side of said developing zone with respect to the rotation direction of said image-bearing member.

9. A method of electrostatically forming a visual image on a recording sheet, the method comprising the steps of:

electrostatically charging a surface of a rotating hollow cylindrical image-bearing member made of a light-transmitting material to a uniform potential;

exposing the electrostatically charged surface of said image-bearing member to a light image of original informational data being reproduced from a rear side to form an electrostatic latent image corresponding to said original informational data;

developing said latent image by bringing a magnetic developer containing an electrically insulating and triboelectrically chargeable toner into contact therewith in a developing zone to form a toner image on said image-bearing member, said developer being attracted to the surface of a rotating flexible developing roll including one of a hollow and a solid flexible cylindrical permanent magnet member, being formed into a thin layer of 10–100 $\mu$m in thickness by a doctor blade tangentially disposed in pressure-contact with the surface of said flexible developing roll, and being transported by the rotation of said flexible developing roll to said developing zone where said image-bearing member and said flexible developing roll are brought into close contact with each other through the thin layer of said developer;

transferring said toner image onto a recording sheet; and fixing said transferred toner image to said recording sheet.

10. The method according to claim 9, wherein said surface of said image-bearing member is electrostatically charged by a charging means in an upstream side of said developing zone with respect to the rotation direction of said image-bearing member.

11. The method according to claim 9, wherein said latent image is developed by a magnetic developer selected from the group consisting of one-component magnetic developer and two-component magnetic developer.

12. The method according to claim 9, wherein said surface of said image-bearing member is electrostatically charged by a two-component developer consisting essentially of one of a magnetic and a non-magnetic toner, and of a magnetic carrier in an upstream side of said developing zone with respect to the rotation direction of said image-bearing member.

* * * * *

UNITED STATES PATENT AND TRADEMARK OFFICE

CERTIFICATE OF CORRECTION

PATENT NO. : 5,812,911

DATED : September 22, 1998

INVENTOR(S) : ASANAE

It is certified that error appears in the above-identified patent and that said Letters Patent is hereby corrected as shown below:

Column 12, Line 59, change "and said" to --and wherein said--;

Line 60, delete "wherein".

Signed and Sealed this

Sixteenth Day of March, 1999

*Attest:*

Q. TODD DICKINSON

*Attesting Officer*

*Acting Commissioner of Patents and Trademarks*